United States Patent [19]

McGraw

[11] 4,135,079

[45] Jan. 16, 1979

[54] TANK HEATER ALARM

[76] Inventor: Veral L. McGraw, 3825 SE. 133rd Ave., Portland, Oreg. 97236

[21] Appl. No.: 816,528

[22] Filed: Jul. 18, 1977

[51] Int. Cl.[2] ..... F24H 1/20; H05B 1/02

[52] U.S. Cl. ..... 219/327; 122/504.2; 137/558; 200/220; 219/506; 340/606; 340/689

[58] Field of Search ..... 99/337, 342, 343, 344; 122/504.2; 134/56 D, 56 R, 57 R, 57 D, 57 DL; 137/558; 200/33 A, 220; 219/309, 310, 311, 324, 327, 333, 337, 506; 340/605, 606, 617, 689

[56] References Cited

U.S. PATENT DOCUMENTS

| | | | |
|---|---|---|---|
| 1,510,912 | 10/1924 | Allen | 340/689 X |
| 2,553,968 | 5/1951 | Hallerberg | 340/606 X |
| 2,650,274 | 8/1953 | McCammant | 200/220 X |
| 3,619,558 | 11/1971 | Block | 122/504.2 X |

*Primary Examiner*—J. V. Truhe
*Assistant Examiner*—Susan M. Hoffmann
*Attorney, Agent, or Firm*—Lee R. Schermerhorn

[57] ABSTRACT

A housing containing a buzzer and mercury switch is mounted on the shaft of the drain lever for a heated tank, for example in a dishwasher. If the heating unit is still turned on when the drain valve is opened, the buzzer sounds to warn the operator that operation of the heating unit without water in the tank will damage the machine.

4 Claims, 6 Drawing Figures

TANK HEATER ALARM

BACKGROUND OF THE INVENTION

This invention relates to a tank heater alarm to warn the operator if the heater is left turned on when the tank is drained.

Commercial dishwashers for restaurant use and the like, for example, have a tank heating unit to maintain a wash water temperature of 140° F. The heating unit, either electric, gas burner or steam, is controlled by a thermostat. A major problem encountered with this type of operation is that, when the tank water is drained, frequently the heating unit is left turned on, resulting is burned out heating units, warped tank or possibly even fire. The thermostat responds to water temperature and does not prevent such damage when the tank is empty. The same problem exists in heated tanks in other appliances, such as steam tables and deep fat fryers.

Objects of the invention are therefore to provide a tank heater alarm and, more specifically, to provide an alarm which will sound if the tank is drained while the heating unit is still turned on.

SUMMARY OF THE INVENTION

The present device is described as applied to dishwashers having a rotatable handle lever to open and close the drain valve. A housing on the shaft of the handle lever contains a buzzer and a mercury switch. When the lever is turned to close the valve the switch is tilted to open circuit position and when the lever is turned to open the valve the switch is turned to closed circuit position to operate the buzzer if the heating unit is turned on.

The alarm circuit is energized from a circuit which is energized to operate the heating unit. In the case of an electric heating unit the alarm circuit is energized directly from the heating unit circuit. When the heating unit is a gas burner or a steam unit the alarm circuit is energized from the thermostic control circuit which actuates a solenoid valve for the gas or steam as the case may be.

The invention will be better understood and additional objects and advantages will become apparent from the following description of the preferred embodiments illustrated on the accompanying drawing. Various changes may be made, however, in the details of construction and arrangement of parts and certain features may be used without others. All such modifications within the scope of the appended claims are included in the invention.

DESCRIPTION OF THE PREFERRED EMBODIMENTS

Figure 1:
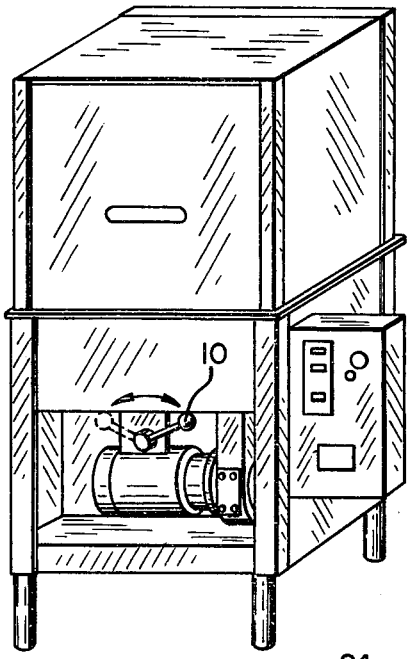
FIG. 1 is a perspective view of a dishwasher embodying the invention.

FIG. 1 shows a common form of commercial dishwasher having a tank with a heating unit to heat the water used in washing dishes. The heating unit, whether it is electric, gas or steam, is controlled by a thermostat maintaining a water temperature of 140° F. Handle lever 10 operates a drain valve to discharge dirty water from time to time so that the tank may be refilled with clean water. Serious damage or even fire may result if the operator fails to turn off the heating unit when the tank is drained. The purpose of the present alarm system is to warn the operator if the heating unit is not turned off when the tank is drained.

Figure 2:
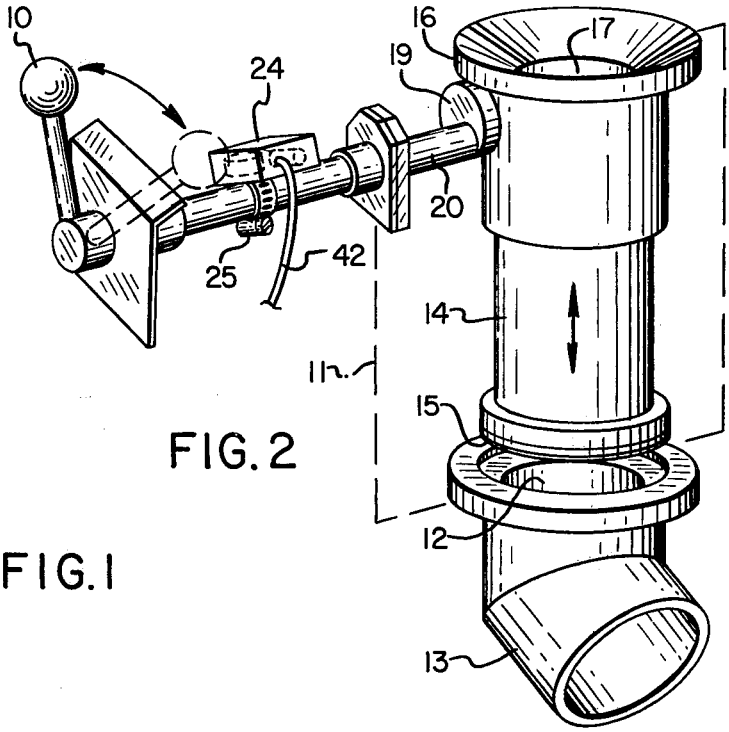
FIG. 2 is a perspective view showing the drain valve and the alarm switch.

In FIG. 2 the tank 11 is represented schematically. The heating unit, not shown, is mounted in or associated with tank 11 to heat the water therein. In the bottom of the tank is a drain opening 12 leading to a drain pipe connection at 13. Overflow tube 14 is mounted for vertical movement in the tank and its lower end is equipped with a sealing ring 15 to close drain opening 12 when the tube is in a lower position.

The upper end of tube 14 is equipped with a flange 16 surrounding the overflow opening 17. Tube 14 is raised and lowered by a cam 19 on a horizontal shaft 20 connected to the handle lever 10. Thus the drain valve is open when the handle lever is in solid line position in FIG. 2 and is closed when the handle lever is turned to broken line position.

Figure 3:
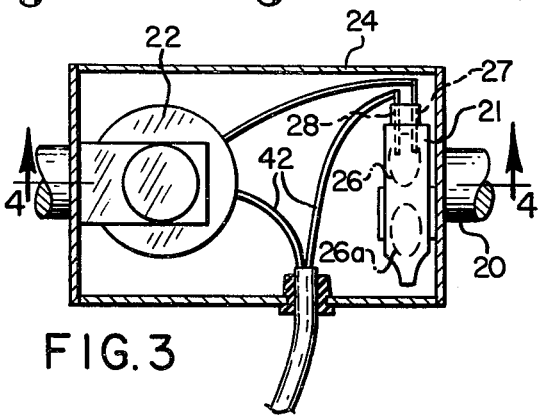
FIG. 3 is a top plan view with parts in section showing the alarm switch and buzzer.
Figure 4:
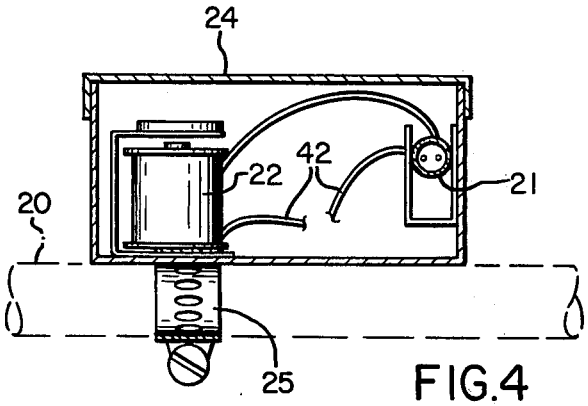
FIG. 4 is a view on the line 4—4 in FIG. 3.

As seen in FIGS. 2, 3 and 4, the present alarm system comprises essentially a mercury switch 21 and buzzer 22 encapsulated in an insulating resin in a housing 24 which is secured to the shaft 20 by a hose coupling 25. Housing 24 is adjusted on shaft 20 so that the mercury globule 26 in switch 21 will close a circuit between contacts 27 and 28 when shaft 20 is rotated to open the drain valve 15. This completes a circuit to operate the buzzer alarm 22. When shaft 20 is rotated to close drain valve 15 the switch 21 tilts in the opposite direction to shift the mercury globule away from contacts 27 and 28 as indicated at 26*a* to open the circuit to buzzer 22.

Figure 5:
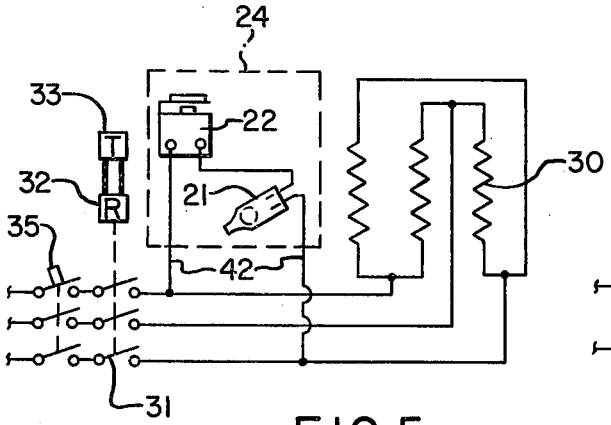
FIG. 5 is a wiring diagram for an electric heating unit.

FIG. 5 is a wiring diagram illustrating the application of the present alarm system to an electric heating unit 30 of the water tank. The water is maintained at the desired temperature by relay switch 31 having a solenoid coil 32 controlled by a thermostat 33 to open and close the circuit to heating unit 30. This thermostat responds to water temperature and is not effective to prevent overheating of heating unit 30 in the absence of water in the tank.

If the manual main switch 35 is left closed after the water has been drained from the tank the tilting of mercury switch 21 when shaft 20 is rotated to open the valve 15 will operate the buzzer 22 whenever relay switch 31 closes, to remind the operator to open the main switch 35 to the heating unit. After valve 15 has been closed for the refilling of the tank, mercury switch 21 tilts to the opposite direction as shown in FIG. 5 to prevent operation of the buzzer.

Figure 6:
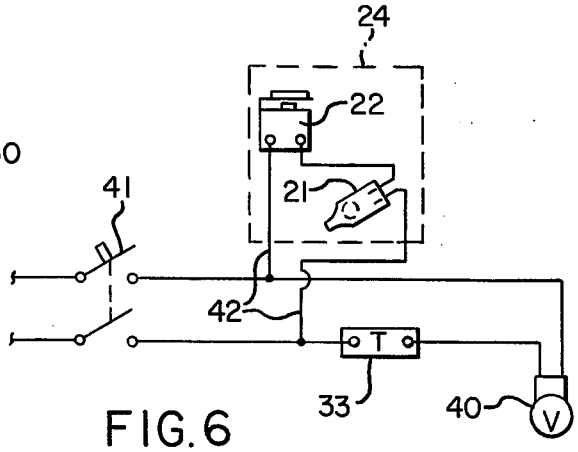
FIG. 6 is a wiring diagram for application to a gas or steam heating unit.

FIG. 6 is a wiring diagram illustrating the application of the present alarm system to gas or steam heating units. Solenoid valve 40 controls the flow of gas or steam to the heating unit, as the case may be. This valve is normally controlled by thermostat 33 to maintain the desired water temperature in the tank but this thermostat, being responsive to water temperature in the tank, may not be effective to prevent overheating in the absence of water. If the operator should neglect to open manual switch 41 when the tank is drained, the rotation of shaft 20 to drain position will tilt mercury switch 21 to energize buzzer 22. When shaft 20 is rotated to close drain valve 15 the mercury switch is tilted in the opposite direction to open the buzzer alarm circuit.

The present alarm system may readily be applied to existing dishwashers by merely securing the housing 24 to shaft 20 by hose coupling 25 and connecting the lead wires 42 to the electrical system as shown in FIGS. 5 or 6.

As mentioned, the same problem exists in other appliances having heated tanks. A restaurant steam table may be damaged by draining out the water while the heating unit is left turned on. In a deep fat fryer, fire may result from pouring new cooking oil on a heating unit which became overheated after draining out the previous oil without turning off the heating unit.

Although pilot lights are often provided to indicate when the heating unit is operating, they may go unnoticed and are largely ineffective. A loud alarm compels attention from an inexperienced or careless operator.

In the present system the alarm sounds automatically if the liquid drain valve is opened while the heating unit is operating or if the heating unit is turned on by thermostat while the drain valve is open. Manual switch 35 in FIG. 5 is not necessary if the temperature adjustment for thermostat 33 includes an "off" position to maintain heating unit 30 deenergized.

What is claimed is:

1. In an appliance having a tank, an electrically controlled heating unit to heat liquid in said tank, and a tank drain valve, the improvement comprising an alarm circuit energized from a circuit which is energized to operate said heating unit, and a control switch for actuating an alarm in said alarm circuit which is closed by the opening of said drain valve.

2. The invention of claim 1 including a manual lever mounted on a shaft for operating said valve, said control switch being actuated by said shaft to close when said lever is turned to open said valve and to open when said lever is turned to close said valve.

3. The invention of claim 2, said control switch being a mercury switch mounted on said shaft.

4. The invention of claim 3 including a housing containing said control switch and alarm, and a hose clamp mounting said housing on said shaft.

* * * * *